US006171007B1

(12) United States Patent
Hsu

(10) Patent No.: US 6,171,007 B1
(45) Date of Patent: Jan. 9, 2001

(54) WASHING CAKE OF SOAP AND ITS FABRICATION METHOD

(76) Inventor: Wei-Ling Hsu, 7F, No. 69-2, Alley 27, Lane 372, Sec. 5, Chung-Hsiao E. Rd., Taipei (TW)

( * ) Notice: Under 35 U.S.C. 154(b), the term of this patent shall be extended for 0 days.

(21) Appl. No.: 09/300,433

(22) Filed: Apr. 28, 1999

(51) Int. Cl.[7] ..... A45D 40/00

(52) U.S. Cl. ..... 401/201; 15/104.93; 401/8; 510/147; 510/458; 510/481; 510/483

(58) Field of Search ..... 401/8, 201; 15/104.93, 15/244.4, 229.11, 229.12; 510/147, 458, 481, 483

(56) References Cited

U.S. PATENT DOCUMENTS 389,296 * 9/1888 Greeley ..... 15/104.93
681,324 * 8/1901 Hubbell ..... 15/229.12 X
1,416,962 * 5/1922 Meeks ..... 401/8 X
3,160,523 * 12/1964 Hull ..... 401/8 X
4,062,792 * 12/1977 McNabb ..... 401/201 X
4,335,007 * 6/1982 Owens ..... 510/142
4,493,786 * 1/1985 Joshi ..... 510/147
5,869,437 * 2/1999 Wolfersberger ..... 510/147

FOREIGN PATENT DOCUMENTS

29809874 * 11/1998 (DE) .

* cited by examiner

*Primary Examiner*—Henry J. Recla
*Assistant Examiner*—Kathleen J. Prunner
(74) *Attorney, Agent, or Firm*—Bacon & Thomas

(57) ABSTRACT

A washing cake of soap, which includes a cake of solid cleaning substance, and a net embedded in the cake of solid cleaning substance. The washing cake of soap is made by putting a net and a liquid cleaning substance in the cavity of a mold, and then letting the liquid cleaning substance to be dried and hardened in the mold.

1 Claim, 5 Drawing Sheets

WASHING CAKE OF SOAP AND ITS FABRICATION METHOD

BACKGROUND OF THE INVENTION

The present invention relates to a washing cake of soap and its fabrication method. The washing cake of soap comprises a cake of solid cleaning substance, and a net embedded in the cake of solid cleaning substance.

Soap is commonly used for cleaning the body. However, we may encounter various problems when cleaning the body of a cake of soap. These problems are as follows:

1. Because the cake of soap is slippery, it produces little friction effect when rubbed against the body.
2. Because the cake of soap must be washed with water when cleaning the body, it dissolves quickly when wet.
3. In order to achieve a satisfactory cleaning effect, we may apply the cake of soap to a washing sponge or towel, and then use the washing sponge or towel to rub the body. However, this method consumes much cleaning substance of the cake of soap, and the washing sponge or towel must be well washed to remove residual cleaning substance after bathing.
4. After bathing adhered water drops cause the washing cake of soap to dissolve continuously. When putting the washing cake of soap in a soap case, the washing cake of soap cannot be prohibited from touching accumulated water in the soap case.

SUMMARY OF THE INVENTION

The present invention has been accomplished to provide a washing cake of soap which eliminates the aforesaid problems. According to the present invention, the washing cake of soap comprises a cake of solid cleaning substance, and a net embedded in the cake of solid cleaning substance. A hanging loop may be formed integral with the net and disposed outside the cake of solid cleaning substance for hanging. The cake of solid cleaning substance can be made transparent or semi-transparent, or having any of a variety of colors. The net can have any of a variety of shapes, and a particular color different from the color of the cake of solid cleaning substance. The washing cake of soap is made by putting a net and a liquid cleaning substance in the cavity of a mold, and then letting the liquid cleaning substance to be dried and hardened in the mold. Because the washing cake of soap has a net embedded in it, it effectively removes dirt from the body when rubbing the washing cake of soap over the body. When viewed through the cake of cleaning substance, the pattern and color of the net cause a sense of beauty. When the washing cake of soap is put in a soap case after bathing, the protruding peripheral part of the net spaces the cake of cleaning substance from accumulated water in the soap case, enabling the washing case of soap to be quickly dried. After use of the washing cake of soap, the remaining net can be used as container means for holding things, or decorative means for decoration.

DETAILED DESCRIPTION OF THE PREFERRED EMBODIMENT

Figure 1:
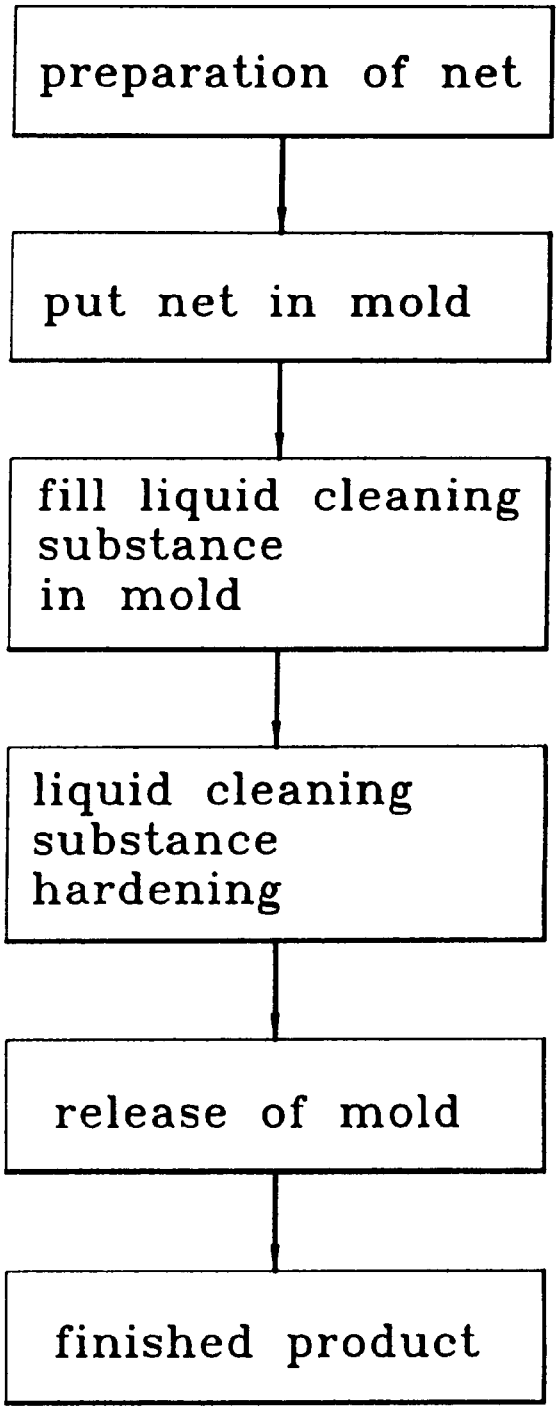
FIG. 1 is a block diagram explaining the soap fabrication flow according to the present invention.
Figure 2A:
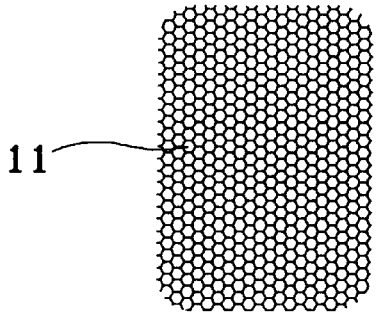
FIG. 2A illustrates a net prepared according to the present invention.
Figure 2B:
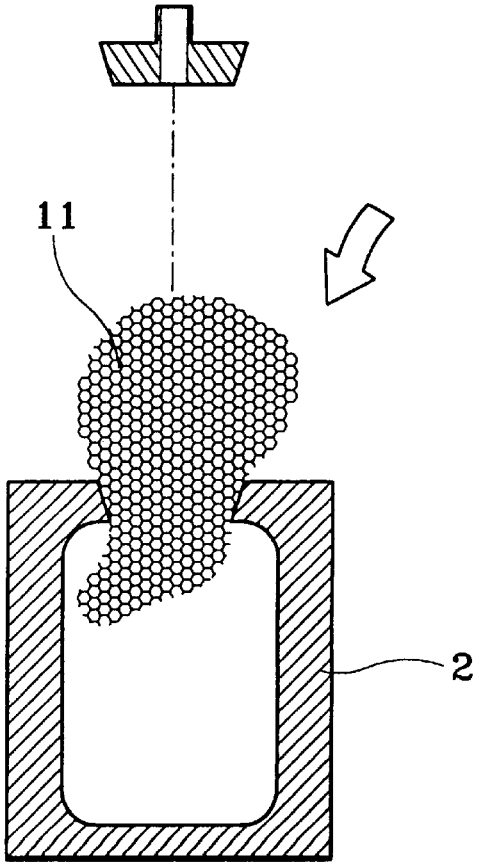
FIG. 2B shows the net put in a mold during the fabrication of a washing cake of soap according to the present invention.
Figure 2C:
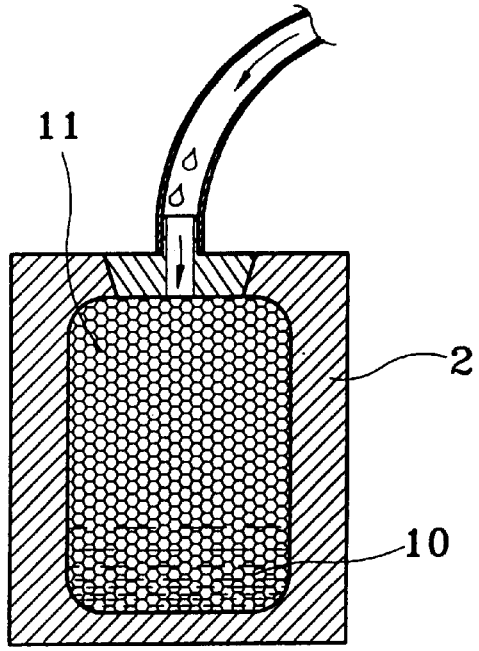
FIG. 2C shows a liquid soap material being filled in the mold during the fabrication of a washing cake of soap according to the present invention.
Figure 2D:
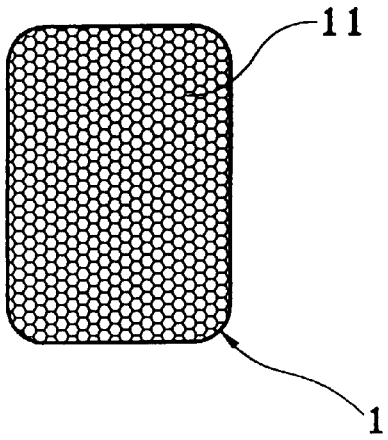
FIG. 2D illustrates a finished washing cake of soap according to the present invention.

Referring to FIG. 1 and Figures from 2A through 2D, a net 11 is prepared and arranged into a predetermined shape (see FIG. 2A), and then put in the cavity of a mold 2 (see FIG. 2B), and then liquid soap material 10 is guided into the mold 2 to fill up the cavity of the mold 2 (see FIG. 2C), and then the mold 2 is heated or put in a cooling area to let the liquid soap material 10 be hardened, and a finished washing cake of soap 1 with a net 11 embedded in it is thus obtained (see FIG. 2D). The net 11 is preferably made of polyethylene material by a heat press for the advantage of water-proof and elastic material properties. The elastic strength of the net 11 is determined subject to the preparation of polyethylene material. Perfume and/or antiseptics may be added to polyethylene material for making the net 11.

Figure 3:
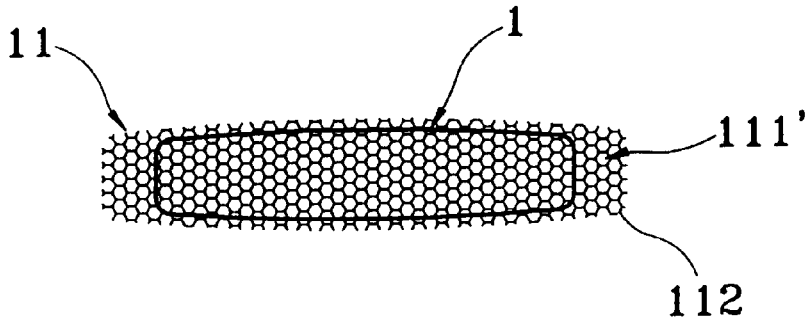
FIG. 3 illustrates the peripheral part of the net exposed to the outside of the cake body of the washing cake of soap according to the present invention.

Referring to FIG. 3 and FIG. 2D again, the net 11 which is embedded in the finished washing cake of soap 1 has open spaces 111' in it. When washing the body with the washing cake of soap 1, the outside wall of the washing cake of soap 1 is softened and gradually rubbed away, causing the peripheral part 112 of the net 11 to be exposed to the outside. When rubbing the washing cake of soap 1 over the body, the body is cleaned by the cleaning substance (soap material) dissolved from the washing cake of soap 1, and massaged by the peripheral part 112 of the net 11.

Figure 4:
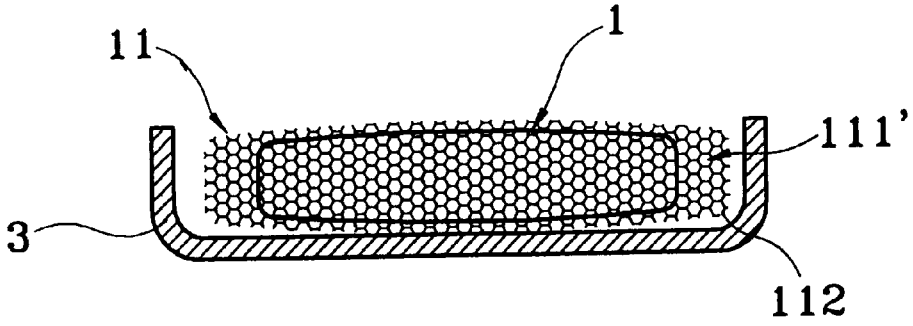
FIG. 4 shows the washing cake of soap put in a soap case, the protruding peripheral part of the net of the washing cake of soap disposed in contact with the inside wall of the soap case.

Referring to FIG. 4, when not in use, the washing cake of soap 1 is received in a soap case 3. Because the peripheral part 112 of the net 11 is exposed to the outside and disposed in contact with the inside wall of the soap case 3, the cleaning substance of the washing cake of soap 1 is prohibited from touching accumulated water in the soap case 3, and air is allowed to pass through the open spaces 111' in the exposed peripheral part 112 of the net 1, enabling the washing cake of soap 1 to be quickly dried.

Figure 6:
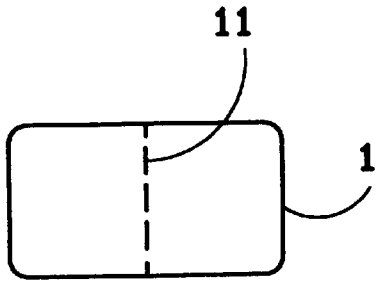
FIG. 6 illustrates a cross-sectional view of a bar of soap with the net embedded therein.

As indicated above and further illustrated in FIG. 6, the washing cake of soap 1 has a net 11 embedded in it. The cleaning substance (soap material) of the washing cake of soap 1 and the net 11 can be made transparent, semi-transparent, or colored. For example, the cleaning substance of the washing cake of soap 1 can be made transparent and the net 11 can be made having a particular color, so that the color and shape of the net 11 can be viewed through the transparent body of the washing cake of soap 1.

Figure 5:
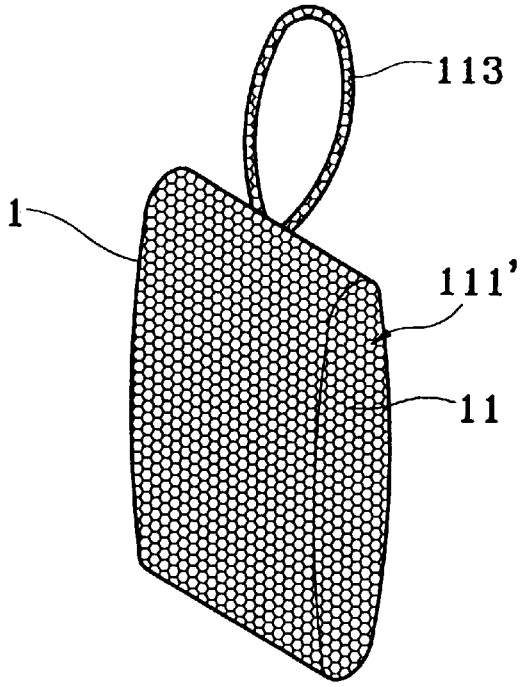
FIG. 5 illustrates a hanging loop formed integral with the net of the washing cake of soap according to the present invention.

Referring to FIG. 5, a hanging loop 113 may be formed integral with the net 11, and protruded over the outside wall of the body of the washing cake of soap 1 for hanging. Through the hanging loop 113, the washing cake of soap 1 can be hung on a high place and quickly dried in the air.

What is claimed is:

1. A method of fabricating a washing cake of soap comprising the steps of:

i) using a plastic compound containing polyethylene resin, a perfume and antiseptics to make a net and arranging the net into a predetermined shape;

ii) putting the net thus obtained in the cavity of a mold;

iii) filling a liquid cleaning substance in the cavity of the mold, enabling the net to be dipped in the liquid cleaning substance;

iv) enabling the liquid cleaning substance to be dried and hardened in the mold, forming a washing cake of soap; and v) taking the hardened washing cake of soap out of the mold.

* * * * *